US005311101A

United States Patent [19]

Noriki et al.

[11] Patent Number: 5,311,101

[45] Date of Patent: May 10, 1994

[54] LIGHTING FAILURE DETECTOR FOR A LUMINAIRE

[75] Inventors: Toshitaka Noriki; Kaoru Tanaka; Hiroki Shinzaki, all of Ishikawa, Japan

[73] Assignee: Kagatsu Kabushiki Kaisha, Tokyo, Japan

[21] Appl. No.: 28,425

[22] Filed: Mar. 9, 1993

[30] Foreign Application Priority Data

Jun. 5, 1992 [JP] Japan ..... 4-146014

[51] Int. Cl.[5] ..... H05B 37/02

[52] U.S. Cl. ..... 315/129; 315/159; 315/360; 340/641

[58] Field of Search ..... 315/129, 360, 159, 158, 315/156; 340/641

[56] References Cited

U.S. PATENT DOCUMENTS

| | | | |
|---|---|---|---|
| 3,450,939 | 6/1969 | Misencik | 315/156 |
| 3,654,514 | 4/1972 | Kappenhagen | 315/156 |
| 3,678,499 | 7/1972 | McCarty | 315/129 |
| 4,198,563 | 4/1980 | Elssner | 315/360 |
| 4,354,180 | 10/1982 | Harding | 340/641 |
| 4,423,478 | 12/1983 | Bullock et al. | 315/159 |
| 4,451,763 | 5/1984 | Sodini | 315/159 |
| 4,745,339 | 5/1988 | Izawa et al. | 340/641 |
| 4,751,399 | 6/1988 | Koehring et al. | 315/159 |
| 5,057,814 | 10/1991 | Onan et al. | 340/641 |
| 5,086,294 | 2/1992 | Kasegi | 340/641 |

FOREIGN PATENT DOCUMENTS

| | | | |
|---|---|---|---|
| 260092 | 2/1990 | Japan . | |
| 112096 | 4/1990 | Japan | 340/641 |

*Primary Examiner*—John T. Kwon

*Attorney, Agent, or Firm*—Thomas R. Morrison

[57] ABSTRACT

A lighting failure detector for a luminaire which ascertains that a lamp is lit at night and indicates the result of detection includes a phase difference detector circuit for ascertaining the lighting of the lamp through voltage and current applied to the lamp, a timer operating in response to an output signal from the phase difference detector circuit, and an indicator operated in response to a time-up signal from the timer.

2 Claims, 4 Drawing Sheets

LIGHTING FAILURE DETECTOR FOR A LUMINAIRE

BACKGROUND OF THE INVENTION

1. Field of the Invention

The present invention relates to a lighting failure detector for a luminaire, and more particularly to a detector for ascertaining that a lamp, such as a street lamp, is automatically lit at night and indicating a failure if any.

2. Description of the Prior Art

A lamp, such as a street lamp capable of automatically lighting in the dark is not lit during the daytime, and a daytime inspecting patrol cannot ascertain whether or not the particular lamps were lit at night.

In order to overcome the inconvenience encountered by the daytime inspecting patrol, there is a proposal which is disclosed in Japanese Patent Kokai No. 2-60092 which shows a lighting failure detector for a luminaire which indicates an occurrence of any lighting failure at night and retains it until daytime.

This known lighting failure detector uses a photocell for detecting the illuminance of the lamp and natural illuminance in daytime, and an indicator functioning as a memory. It is operated as follows:

When night falls and the lamp is automatically lit, the photocell does not operate the indicator by detecting the illuminance of the lamp. However, if the lamp is not lit, the photocell detects a decrease in natural light, and operates the indicator through which the lighting failure is known.

The operation of the prior art lighting failure detector depends upon the light detected by the photocell. The disadvantage of the photocell is that it deteriorates under ultraviolet and heat radiating from the lamps. As a result, the prior art lighting failure detector is likely to malfunction and cannot endure a long period of use.

OBJECTS AND SUMMARY OF THE INVENTION

The present invention is directed to overcome the disadvantages and difficulties discussed above.

According to the present invention, there is a lighting failure detector for ascertaining that a lamp is automatically lit at night and indicating a failure if any, which detector includes a phase difference detector circuit for ascertaining the lighting of a lamp through voltage and current applied to the lamp, a timer operated in response to an output signal from the phase difference detector circuit, and an indicator operated in response to a time-up signal from the timer.

Alternatively, the timer can operate in response to an actuating signal from an automatic switch circuit for the lamp.

The phase difference detector circuit detects the lighting and failure (non-lighting) condition of the lamp through voltage and current applied to the lamp, and the timer operates in response to an output signal generated by the phase difference detector circuit. If non-lighting is detected over a night-and-day period of time, a time-up signal from the timer indicates that the particular lamp is defective. In response to the time-up signal, the indicator indicates the lighting failure.

When the lamp is provided with an automatic switch circuit, the timer operates in response to an actuating signal from the automatic switch circuit. In this case, the timer detects a time when the lamp ought to be lit in response to the actuating signal, and if the lamp remains extinct over a predetermined period of time, the timer generates a time-up signal. This embodiment is advantageous in that if the lamp abnormally continues to blink because of a defective ballast or other component, the indicator is activated and indicates the failure.

Thus, the invention described herein makes it possible to detect a lighting failure of a lamp electrically without using a photoelectric cell, thereby achieving high reliable detection of lighting failure.

BRIEF DESCRIPTION OF THE DRAWINGS

This invention may be better understood and its numerous objects and advantages will become apparent to those skilled in the art by reference to the accompanying drawings as follows.

DETAILED DESCRIPTION OF THE PREFERRED EMBODIMENT

Figure 1:
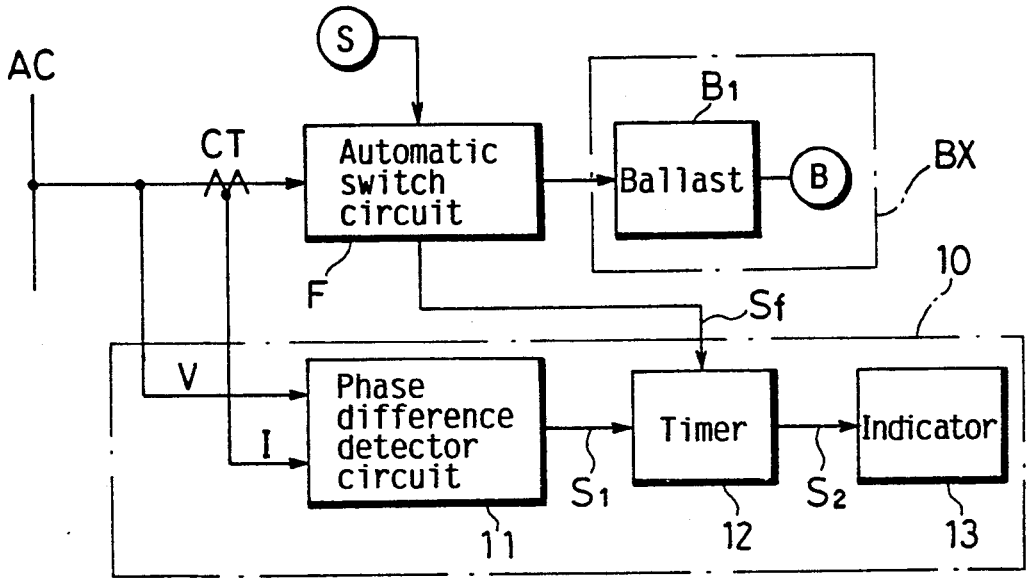
FIG. 1 is a block diagram showing the entire structure of a lighting failure detector according to the present invention.

Referring to FIG. 1, the exemplary lighting failure detector 10 includes a phase difference detector circuit 11, a timer 12, and an indicator 13. The circuit 11 is used in association with a lamp BX equipped with a automatic switch circuit F.

The lamp BX includes a ballast B1 and a bulb B, and is supplied with electric power through the automatic switch circuit F from a power source AC. The automatic switch circuit F includes a photocell S, and automatically lights and extinguishes the lamp BX in accordance with the illuminance of natural light detected by the photocell S.

The phase difference detector circuit 11 receives voltage V from the power source AC and current I which is to be supplied to the lamp BX through the automatic switch circuit F. The current I is detected through a transformer CT.

An output signal S1 from the phase difference detector circuit 11 is directed to the timer 12, and a time-up signal S2 from the timer 12 is directed to the indicator 13.

Figure 2:
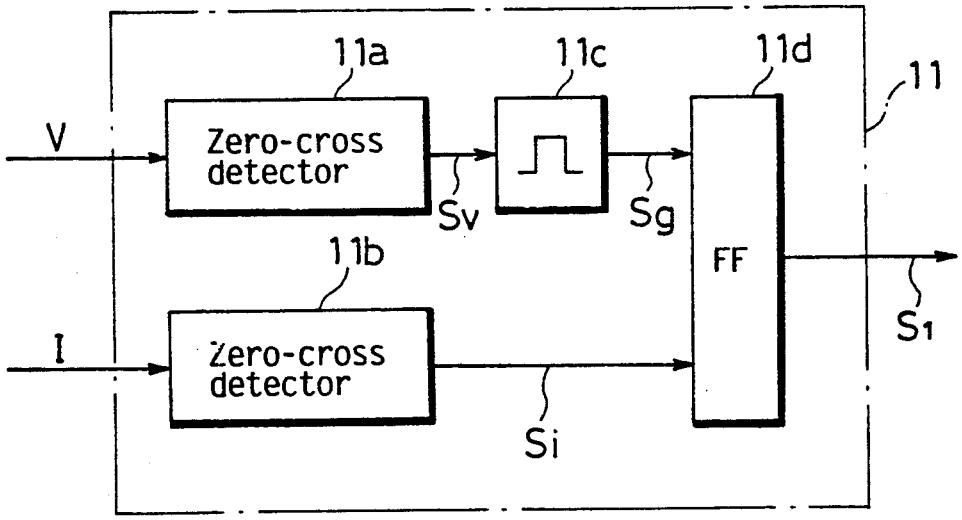
FIG. 2 is a block diagram showing a main portion of the lighting failure detector of FIG. 1.

The phase difference detector circuit 11 includes a pair of zero-cross detectors 11*a* and 11*b*, a monostable multi-vibrator 11*c* and a flip-flop 11*d* to which the voltage V and the current I are respectively directed as shown in FIG. 2. The output of the zero-cross detector 11*a* is connected to the flip-flop 11*d* through the monostable multi-vibrator 11*c*, and that of the zero-cross detector 11*b* is directly connected to the flip-flop 11*d*.

Figure 3:
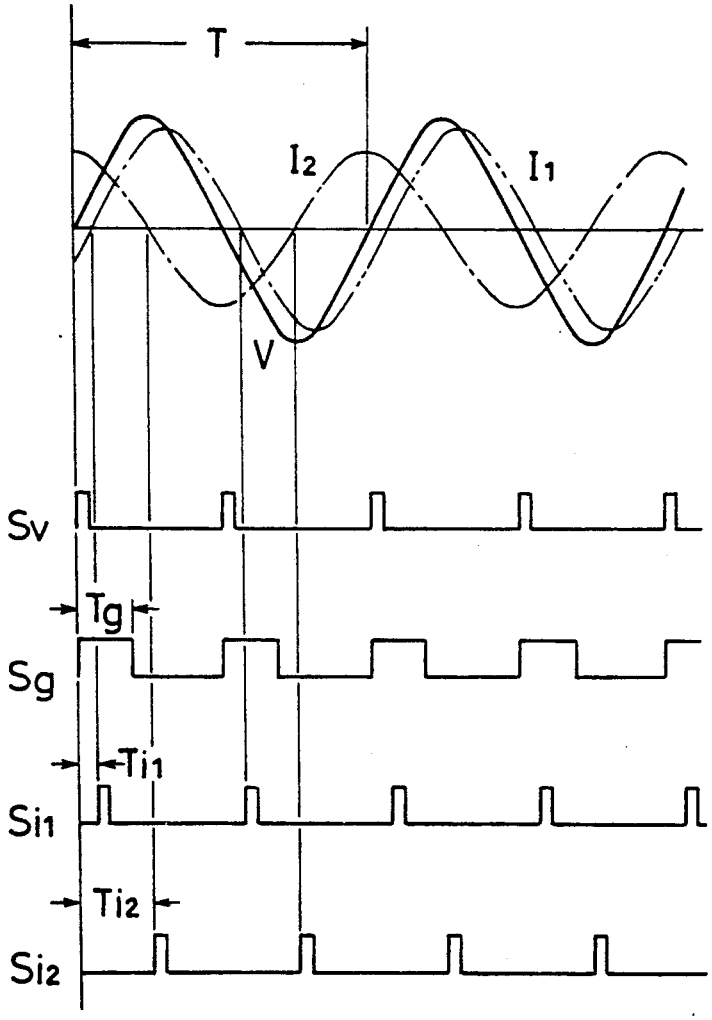
FIG. 3 is a timing chart showing the operation of the embodiment of FIG. 1.

In general, the lamp BX is equipped with a capacitor (not shown) for improving the power-factor whereby if the lamp is not lit in spite of its connection to the power source AC through the automatic switch circuit F, the current I advances by 90° in phase, thereby resulting in an advancing power factor of 0% as indicated by the waveform $I_2$ in FIG. 3, whereas, when the lamp BX lights up, the current I has a lagging power factor of 80% to 95% in phase as indicated by the wave form $I_1$.

The zero-cross detector 11*a* generates a zero-cross signal Sv when the voltage V goes through zero, and the monostable multi-vibrator 11*c* generates a gate signal Sg in response to the zero-cross signal Sv. The zero-cross detector 11*b* can generate a zero-cross signal Si when the current I goes through zero, wherein the gate signal Sg has a pulse width Tg of not greater than T/4 for a cycle T of the voltage V.

When the lamp BX is lit, the zero-cross signal $Si=Si_1$ lags behind the zero-cross signal Sv by a time $Ti_1$ which corresponds to the lagging power factor of 80 to 90%. When the lamp BX fails to light up, the zero-cross signal $Si=Si_2$ lags behind the zero-cross signal Sv by a time of $Ti_2 \approx T/4$, which corresponds to an advancing power factor of 0%. Therefore, it is determined that the pulse width Tg falls in the relationship $Ti_1 < Tg < Ti_2$ so that the zero-cross signal $Si_1$ at the time of lighting up falls within the range of the gate signal Sg, whereas the zero-cross signal $Si_2$ at the time of failing to light up falls outside the range of the gate signal Sg, as shown in FIG. 3.

The flip-flop 11*d* inputs the gate signal Sg and the zero-cross signal Si, and is set when both signals Sg and Si are present. It is reset when the zero-cross signal Si is present having no zero-cross signal Sg. The output signal $S_1$ generated by the flip-flop 11*d* becomes high when the lamp BX is lit, and low for the lighting failure. As a result, the phase difference detector circuit 11 detects the lighting condition or lighting failure condition of the lamp Bx, and generates an output signal $S_1$.

An actuating signal Sf is applied to the timer 12 from the automatic switch circuit F. Now, suppose that the actuating signal Sf indicates that the lamp BX is thrown into a lighting condition by the automatic switch circuit F. The timer 12 measures a period of time for which the lamp BX continues to be extinct, by measuring a period of time for which the output signal $S_1$ from the phase difference detector circuit 11 remains low irrespective of the presence of the actuating signal Sf. When the measured period of time exceeds a predetermined period of time, the timer 12 generates a time-up signal $S_2$. The indicator 13 indicates the lighting failure, and memorizes it as information.

The timer 12 can sum up the periods of time for which the lamp BX remains extinct so long as the actuating signal Sf is present. More specifically, the timer 12 and the indicator 13 can respond not only to a simple lighting failure of the lamp BX but also to an abnormal blinking of it. The timer 12 stops measuring the time in response to the extinction of the actuating signal Sf, and is reset for the next operation. The indicator 13 is manually reset during a regular inspecting patrol.

Figure 4:
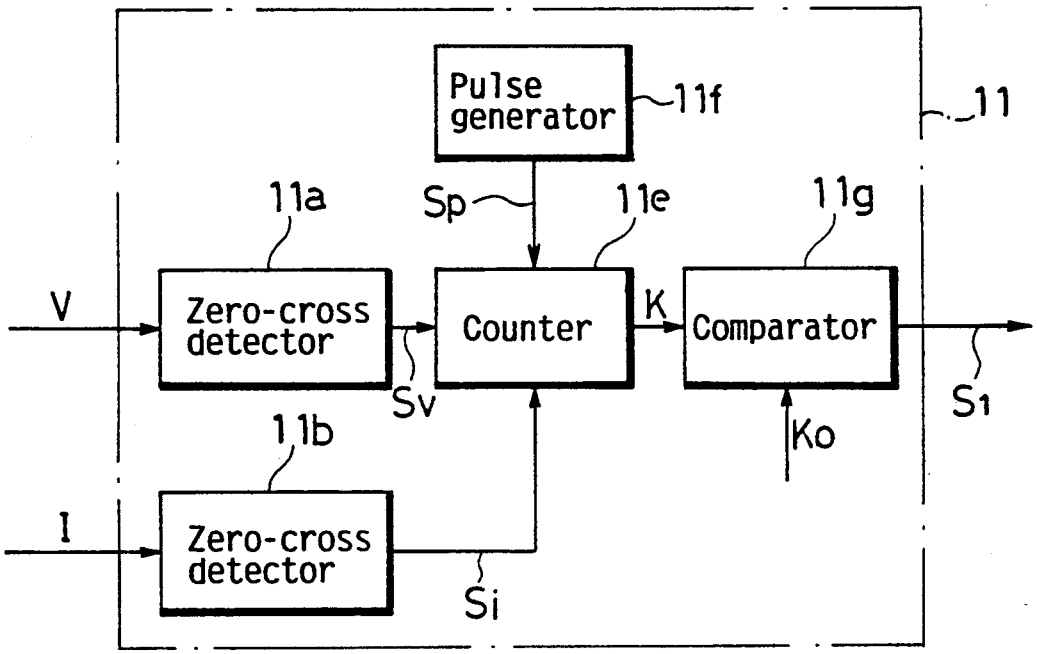
FIG. 4 is a block diagram showing a main portion of another embodiment.

Modified embodiments will be described:

Referring to FIG. 4, instead of the monostable multivibrator 11*c* and the flip-flop 11*d*, the phase difference detector circuit 11 can be composed of a counter 11*e* equipped with a pulse generator 11*f*, and a comparator 11*g*. The pulse generator 11*f* is a high frequency pulse generator, and the counter 11*e* counts high-frequency pulse signals Sp delivered by the pulse generator 11*f* from the time when the zero-cross signal Sv is supplied to the time when the zero-cross signal Si is supplied. The number K of the high-frequency pulse signal Sp that is counted by the counter 11*e* indicates the phase difference of the current I to the voltage V. When the counted number K is not greater than a predetermined value $K_0$ ($K \leqq K_0$), the lamp BX is lit. When the counted number K is greater than a predetermined value $K_0$ ($K > K_0$), it is understood that the lighting failure of the lamp BX has occurred, wherein an output signal $S_1$ is generated.

Figure 5:
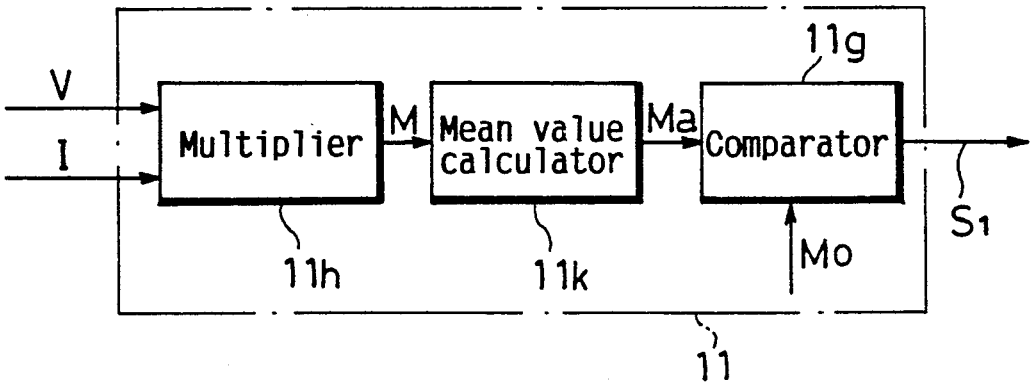
FIG. 5 is a block diagram showing a main portion of another embodiment.

FIG. 5 shows a modified version in which the phase difference detector circuit 11 can be composed of a multiplier 11*h* that inputs the voltage V and the current I, a mean value calculator 11*k*, and a comparator 11*g* connected in series. The multiplier 11*h* multiplies instantaneous values of the voltage V and the current I, and outputs the obtained value M ($V \times I$). In general, the mean value Ma of the multiplied value M is nearly 0 ($Ma \approx 0$) when the current I is different in phase by 90° from the voltage V, and it is greater than 0 ($Ma > 0$) when the current I is the same in phase as the voltage V. The comparator 11*g* ascertains that the lamp BX is lit when Ma is not smaller than $M_0$ (when $M_0$ is a predetermined value), and that it fails to light up when Ma is smaller than $M_0$. Then the comparator 11*g* generates an output signal $S_1$. The mean value calculator 11*k* can be composed of a simple rectifier circuit.

Figure 6:
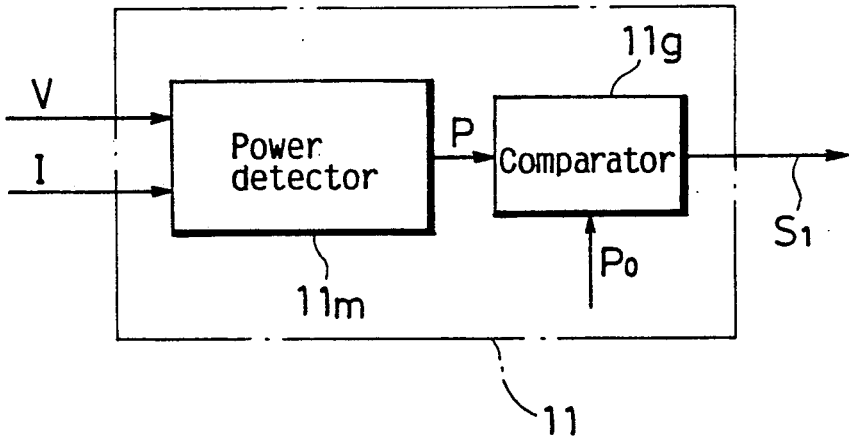
FIG. 6 is a block diagram showing a main portion of a further embodiment.

FIG. 6 shows another modification of the phase difference detector circuit 11 in which a power detector 11*m* and a comparator 11*g* are used in combination. The power detector 11*m* can be provided by an effective power detector using a Hall element. This type of power detector can detect a greater effective power P while the lamp BX is lit, and when the power P is smaller than a predetermined value $P_0$, the comparator 11*g* has only to generate an output signal $S_1$ by judging that the lamp BX fails to light up.

As is evident from the foregoing description, the phase difference detector circuit 11 usable for the present invention can be of any type if it can detect a difference in phase between the voltage V and the current I, or alternatively any electric variables to see whether the lamp BX is lit or fails to light up.

It is not necessarily essential for the timer 12 to use the actuating signal Sf from the automatic switch circuit F. When the timer 12 does not use the actuating signal Sf, the timer 12 is arranged to generate a time-up signal $S_2$ only when the lamp BX remains extinct over the period of daytime. In this case, an auxiliary timer can be additionally interposed between the phase difference detector circuit 11 and the timer 12, thereby enabling the timer 12 to detect an abnormal blinking of the lamp BX. The auxiliary timer ignores a short-time lighting of the lamp BX in the abnormal blinking, and the timer 12 will measure the period of time for an abnormal blinking as the lighting failure.

What is claimed is:

1. A lighting failure detector for a luminaire, comprising a phase difference detector circuit for ascertaining the lighting of a lamp through voltage and current applied to the lamp, a timer operating in response to an output signal from the phase difference detector circuit, and an indicator operated in response to a time-up signal from by the timer.

2. A lighting failure detector for a luminaire according to claim 1, wherein the timer operates in response to an actuating signal from an automatic switch circuit for the lamp.

* * * * *